US005544497A

United States Patent [19]

Inoue

[11] Patent Number: 5,544,497

[45] Date of Patent: Aug. 13, 1996

[54] REGENERATOR FOR ABSORPTION REFRIGERATING MACHINE

[75] Inventor: Naoyuki Inoue, Kanagawa-ken, Japan

[73] Assignee: Ebara Corporation, Tokyo, Japan

[21] Appl. No.: 254,899

[22] Filed: Jun. 6, 1994

[30] Foreign Application Priority Data

Jun. 8, 1993 [JP] Japan ..... 5-163311

[51] Int. Cl.[6] ..... F25B 33/00

[52] U.S. Cl. ..... 62/497; 122/19

[58] Field of Search ..... 62/476, 497, 101; 122/19

[56] References Cited

U.S. PATENT DOCUMENTS

| | | | |
|---|---|---|---|
| 4,570,456 | 2/1986 | Reimann et al. | 62/476 |
| 5,263,340 | 11/1993 | Sekoguchi et al. | 62/497 |
| 5,381,674 | 1/1995 | Omori et al. | 62/497 |

FOREIGN PATENT DOCUMENTS

| | | |
|---|---|---|
| 62-33203 | 2/1987 | Japan . |
| 6-18125 | 1/1994 | Japan . |

*Primary Examiner*—Henry A. Bennett
*Assistant Examiner*—William C. Doerrler
*Attorney, Agent, or Firm*—Armstrong, Westerman, Hattori, McLeland & Naughton

[57] ABSTRACT

In a regenerator for an absorption refrigerating machine which uses combustion gas as a heat source, the regenerator comprises a plurality of drum shells provided in a body casing of the regenerator, each drum shell has a solution inlet provided in a shell part of the drum shell, a solution outlet having an overflow structure and provided in the shell part at a position lower than the solution inlet, a vapor outlet provided in the shell part at a position higher than the solution inlet, a multiplicity of heat transfer fins provided on an outer periphery of a shell part of the drum shell and a circulation guide provided along an inner periphery of the shell part, the plurality of drum shells may be arranged in a side by side parallel and/or in an up and down series relationship to increase the capacity of the regenerator by proportional design.

2 Claims, 2 Drawing Sheets

REGENERATOR FOR ABSORPTION REFRIGERATING MACHINE

BACKGROUND OF THE INVENTION

1. Field of the Art

The present invention relates to a regenerator for an absorption refrigerating machine and, more particularly, to a regenerator for an absorption refrigerating machine which uses combustion gas as a heat source and which is capable of coping with a demand for a large capacity.

2. Prior Art

As conventional regenerators for absorption refrigerating machines, flood type flue and smoke tube regenerators have generally been employed mainly in large-sized absorption refrigerating machines. This type of regenerator suffers, however, from some disadvantages: namely the holding solution quantity is large, and the starting characteristics are inferior. In addition, the heat transfer efficiency is not satisfactorily high, and it is difficult to reduce the overall size of the system.

To achieve a reduction In the overall size of the system, for example, employment of a once-through generator has been examined. With this type of generator, however, it is difficult to handle vapor generated in the tube, and stable running cannot readily be performed. For example, if vapor is localized in the tube, local overheating occurs, causing the problem of corrosion. In addition, the circulation of solution may be impaired by vapor lock or other similar problem, causing crystallization, depending upon the rate of generation.

To solve the above-described problems, the present inventors have previously proposed a regenerator in which a multiplicity of heat transfer fins are provided on the outer periphery of the shell part of a drum shell, and a circulation guide is provided along the inner periphery of the shell part of the drum shell (Japanese Patent Application Public Disclosure No. 6-18125 (1994)).

The above-described invention in the prior application provides a compact regenerator and enables stable heating. With this regenerator, however, it is difficult to achieve a large capacity by way of proportional design.

That is, as the area of heat-transfer surface is increased proportionally the volume increases proportionally to 1.5 powers of the area. As a result, the holding solution quantity exceeds the value of proportionality.

Accordingly, an object of the present invention is to provide a regenerator of the type having a multiplicity of heat transfer fins provided on the outer periphery of the shell part of a drum shell, and a circulation guide provided along the inner periphery of the shell part of the drum shell, which is capable of increasing capacity by way of proportional design.

Another object of the present invention is to provide a regenerator of the above described type which further enables effective use of combustion gas energy while fulfilling the first object.

SUMMARY OF THE INVENTION

To accomplish the above-described first object, the present invention provides a regenerator for an absorption refrigerating machine which uses combustion gas as a heat source. The regenerator comprises a plurality of drum shells provided in a body casing of the regenerator, each drum shell has a solution inlet provided in a shell part of the drum shell, a solution outlet having an overflow structure and provided in the shell part at a position lower than the solution inlet, a vapor outlet provided in the shell part at a position higher than the solution inlet and a multiplicity of heat transfer fins provided on an outer periphery of a shell part of the drum shell. In addition, a circulation guide is provided along an inner periphery of the shell part.

The plurality of drum shells may be arranged in a side by side parallel relationship. In this case, the solution inlet of the each drum shell is connected to a solution supply means from an absorber, the solution outlet of each drum shell is connected to a solution outlet pipe, and the vapor outlet of each drum shell is connected to a vapor outlet pipe.

Instead, the plurality of drum shells may be arranged in an up and down series relationship to accomplish the above-described second object. In this case, the solution inlet of the uppermost drum shell is connected to a solution supply means from an absorber, the solution outlet of the upper drum shell is communicated with the solution inlet of the lower drum shell so that a solution from the upper drum shell sequentially overflows into the lower drum shell or drum shells, whereas a combustion gas first comes into contact with the fins provided on the lowermost drum shell and then sequentially contacts the fins of the upper drum shell or shells.

Further, the plurality of drum shells may be arranged in side by side parallel relationship and in an up and down series relationship. In this case, the solution inlets of the uppermost drum shells are connected with a solution supply means from an absorber, the solution outlets of the upper drum shells are communicated with the solution inlets of the lower drum shell in the corresponding series so that a solution from the upper drum shell is sequentially overflows into the lower drum shell of drum shells in the corresponding series, whereas a combustion gas first comes into contact with said fins provided on the lowermost drum shell and then sequentially contacts the fins of the upper drum shell or shells in the corresponding series, the solution outlets of the lowermost drum shells are connected to a solution outlet pipe, and the vapor outlet of said each drum shell is connected to a vapor outlet pipe.

In this invention, since the regenerator is composed of a plurality of drum shells, as described above, it is possible to achieve a large capacity on the basis of proportional design by increasing the number of drum shells used.

In addition, when a plurality of drum shells are arranged in an up and down series relationship as described above, the solution is allowed to sequentially flow down from an upper drum shell to a lower drum shell, whereas the combustion gas is allowed to sequentially rise from a lower drum shell to an upper drum shell so as to come into contact with the drum shells in sequence, thereby enabling effective use of energy.

The above and other objects, features and advantages of the present invention will become more apparent from the following description when taken in conjunction with the accompanying drawings in which preferred embodiments of the present invention are shown by way of illustrative examples.

PREFERRED EMBODIMENTS OF THE INVENTION

The present invention will be described below more specifically with reference to the accompanying drawings. However, it should be noted that the present invention is not necessarily limited to these embodiments.

Figure 1:
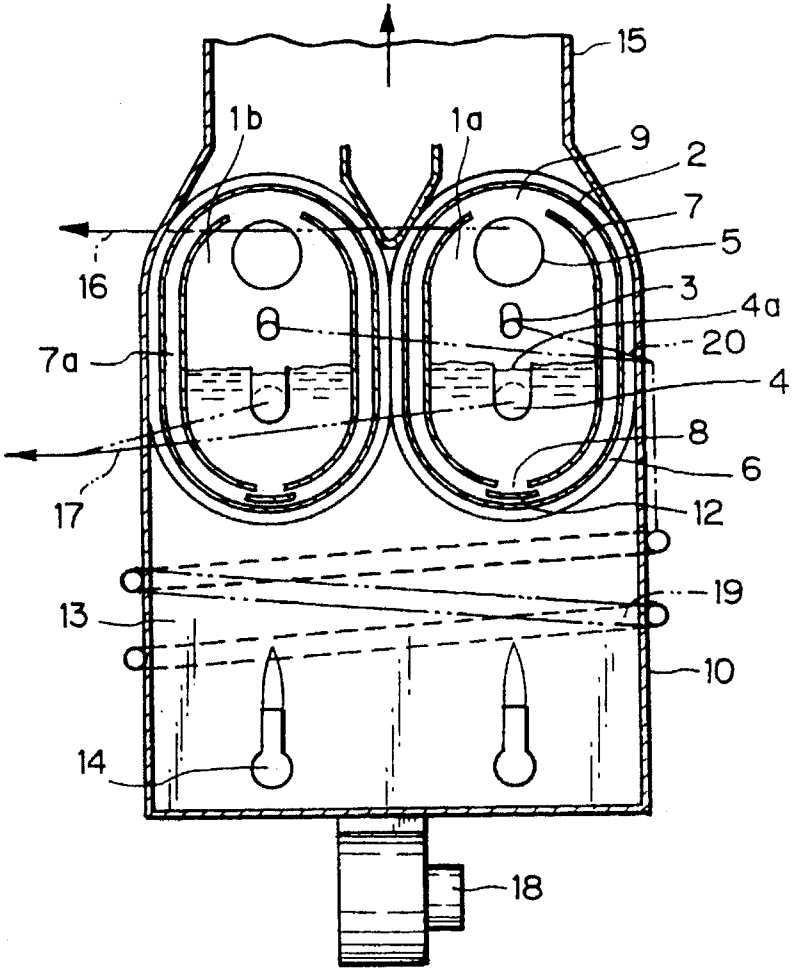
FIG. 1 is a front sectional view of a regenerator showing one embodiment of the present invention.
Figure 2:
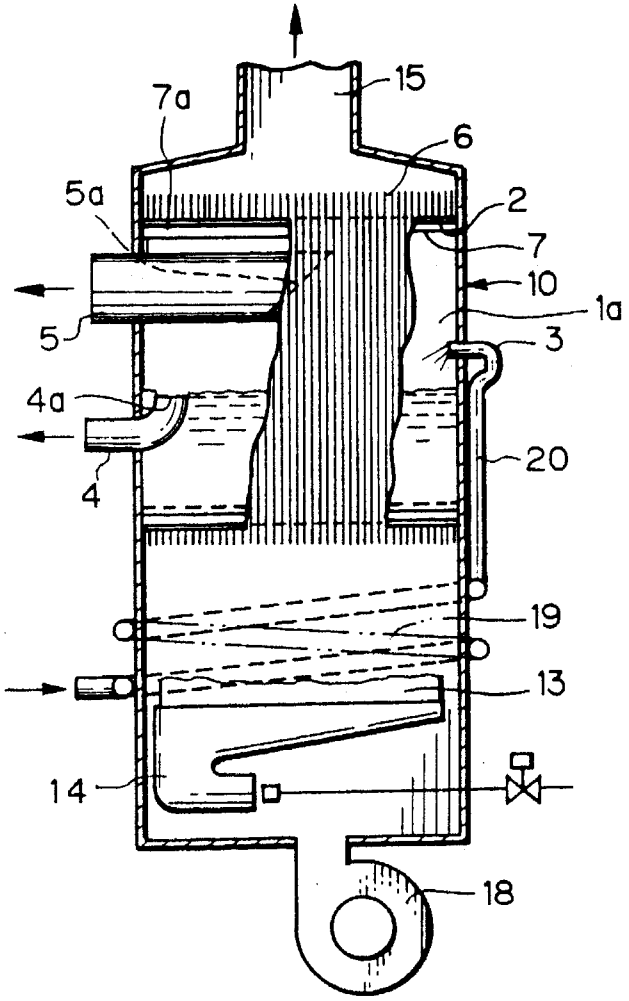
FIG. 2 is a side sectional view of the regenerator shown in FIG. 1.

FIGS. 1 and 2 respectively are front and side sectional views showing one embodiment of the regenerator according to the present invention.

In this embodiment, two drum shells 1*a* and 1*b* are installed in a side by side parallel relationship within a body casing 10 of the regenerator.

Since the two drum shells 1*a* and 1*b* have the same structural arrangement, explanation will be made referring only to one drum shell 1*a*.

Now, referring to FIGS. 1 and 2, the drum shell 1*a* of the regenerator is provided with a solution inlet 3, a solution outlet 4 having an overflow weir 4*a*, and a vapor outlet 5 having a downwardly facing opening 5*a* on the side of a shell part 2 of the drum shell 1*a*. The solution outlet 4 is positioned lower than the solution inlet 3, whereas the vapor outlet 5 is positioned higher than the solution inlet 3. A multiplicity of heat transfer fins 6 are provided on the outer periphery of the shell part 2 of the regenerator drum shell 1*a*. A circulation guide 7 is provided along the inner periphery of shell part 2 to form a circulation guide space 7*a* between the shell part 2 and the circulation guide 7. The circulation guide 7 has openings 8 and 9 respectively provided in the bottom and top thereof. A boiling preventing plate 12 is installed at the bottom opening 8.

A combustion chamber 13 is provided at the lower portion of the regenerator and includes burners 14 to heat the drum shells 1*a* and 1*b* by gas combustion of the burners. The combustion gas is discharged from the regenerator through a discharge guide 15. In FIGS. 16 denotes a vapor outlet pipe, 17 a solution outlet pipe, 18 a burner fan and 19 a solution preheater.

The regenerator shown in FIGS. 1 and 2 is operated as follows. A dilute solution from an absorber (not shown) is preheated by the solution preheater 19 and is supplied to the drum shells 1*a* and 1*b* through distributor pipes 20 and the solution inlet 3. A solution supplied within the drum shell 1*a* enters the circulation guide space 7*a* between the shell part 2 and the circulation guide 7 through the bottom opening 8. The boiling preventing plate 12 installed at the bottom opening 8 prevents the choking of the opening 8 by boiling bubbles. As the solution is heated within the circulation guide space 7*a* between the shell part 2 and the circulation guide 7, a vapor is generated and a gas and a liquid mixture phase condition is produced, which reduces the specific gravity of the solution and causes upward flow of the solution within the space. The solution under gas and liquid mixed phase condition flows out the space 7*a* and enters the drum shell 1*a* through the top opening 9 in the circulation guide 7. The vapor is separated from the solution at the upper space within the drum shell and the solution returns to the drum shell and again enters the circulation guide space through the bottom opening 8 to be heated there. On the other hand, the vapor separated from the solution is discharged from the regenerator through the vapor outlet 5 and a vapor outlet pipe 16. The solution after having generated vapor is condensed and flows out through the overflow weir 4*a*. However, the solution quantity held within the drum shell is maintained above a predetermined value due to the action of the overflow weir 4*a*.

A dilute solution supplied from the absorber is mixed with the existing solution within the drum shell and enters the circulation guide space through the bottom opening 8 to repeat the aforementioned operation.

Figure 3:
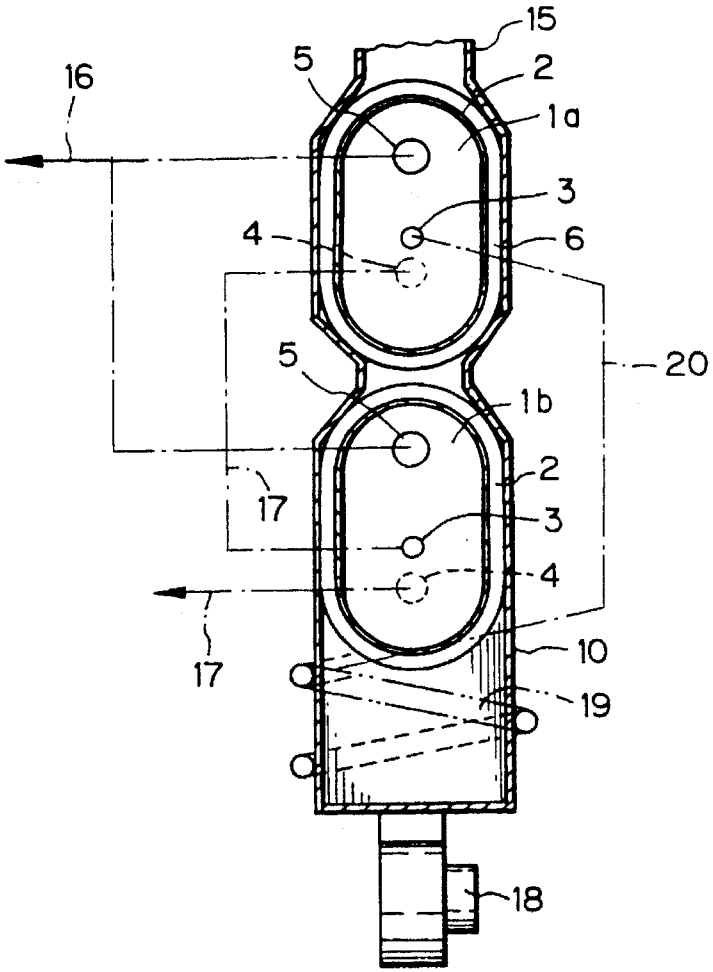
FIG. 3 is a front sectional view of a regenerator showing another embodiment of the present invention.

FIG. 3 is a sectional view of a main part of a regenerator in a case where two drum shells 1*a* and 1*b* are installed in an up and down series relationship. The arrangement of each drum shell is the same as that of the drum shells shown in FIG. 1.

In the regenerator shown in FIG. 3, the solution and the combustion gas are arranged to flow counter to each other. That is, the solution having a relatively low concentration and a relatively low boiling temperature, i.e., dilute solution, is all introduced into the upper drum shell 1*a* and subjected to heat exchange at the combustion gas outlet side, where the temperature is relatively low. As the solution concentration gradually becomes higher and the boiling temperature rises, the solution is allowed to overflow (naturally flow down) into the lower drum shell 1*b* and to exchange heat with the gas having a relatively high temperature at the combustion gas inlet side.

Thus, the combustion gas can be effectively used, and the heat recovery efficiency can be improved.

Figure 4:
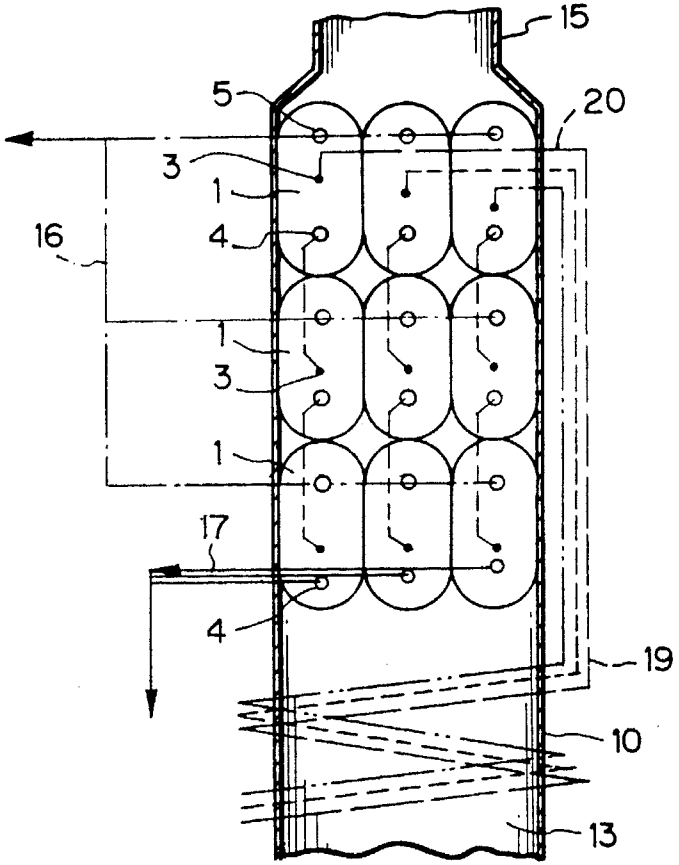
FIG. 4 is a front sectional view of a regenerator showing still another embodiment of the present invention.

FIG. 4 shows an embodiment that uses both parallel and series arrangements of drum shells. In the illustrated example, a total of nine drum shells 1 are installed: three in the vertical direction, and three in the horizontal direction. The arrangement of each drum shell is the same as that of the drum shells shown in FIG. 1.

In this embodiment, the solution inlets 3 of the uppermost drum shells are connected to the solution distribution pipe 20 to supply solution to the regenerator from an absorber. The solution outlets 4 of the upper drum shell are communicated with the solution inlets 3 of the lower drum shells so that a solution from the upper drum shell sequentially overflows into the lower drum shell or drum shells in the corresponding series. On the other hand, a combustion gas first comes into contact with the fins provided on the lowermost drum shell and then sequentially contacts the fins of the upper drum shell or shells in the corresponding series. The solution outlets 4 of the lowermost drum shells are connected to a solution outlet pipe 17. The vapor outlet 5 of the each drum shell is connected to a vapor outlet pipe 16.

The combustion gas is generally obtained by burning natural gas or oil with a burner. Illustration of a burner and other associated elements is omitted in the figure.

Incidentally, the number of the drum shells arranged in parallel and or in series is not limited to the illustrated numbers, but may be changed according to the required design capacity of the regenerator.

As described above, according to the present invention having the above-describe arrangement, it is possible to provide a proportional design and achieve a large capacity by increasing the number of drum shells used.

Also, by disposing the drum shells in up and down series, it is possible to realize an energy-saving system.

What is claimed is:

1. A regenerator for an absorption refrigerating machine which uses combustion gas as a heat source, said regenerator comprising a plurality of drum shells provided in a body casing of said regenerator, said each drum shell having a solution inlet provided in a shell part of said drum shell, a solution outlet having an overflow structure and provided in said shell part at a position lower than said solution inlet, a vapor outlet provided in said shell part at a position higher than said solution inlet, a multiplicity of heat transfer fins provided on an outer periphery of a shell part of said drum shell, and a circulation guide provided along an inner periphery of said shell part; wherein said plurality of drum shells are arranged in an up and down series relationship, said solution inlet of said uppermost drum shell is connected with a solution supply means from an absorber, said solution outlet of the upper drum shell is communicated with said solution inlet of the lower drum shell so that a solution from said upper drum shell sequentially overflows into said lower drum shell or drum shells, whereas a combustion gas first comes into contact with said fins provided on the lowermost drum shell and then sequentially contact the fins of the upper drum shell or shells.

2. A regenerator for an absorption refrigerating machine which uses combustion gas as a heat source, said regenerator comprising a plurality of drum shells provided in a body casing of said regenerator, said each drum shell having a solution inlet provided in a shell part of said drum shell, a solution outlet having an overflow structure and provided in said shell part at a position lower than said solution inlet, a vapor outlet provided in said shell part at a position higher than said solution inlet, a multiplicity of heat transfer fins provided on an outer periphery of a shell part of said drum shell, and a circulation guide provided along an inner periphery of said shell part; wherein said plurality of drum shells are arranged in a side by side parallel relationship and an up and down series relationship, said solution inlets of the uppermost drum shells are connected with a solution supply means from an absorber, said solution outlets of the upper drum shells are communicated with said solution inlets of the lower drum shell in the corresponding series so that a solution from said upper drum shell sequentially overflows into said lower drum shell or drum shells in the corresponding series, whereas a combustion gas first comes into contact with said fins provided on the lowermost drum shell and then sequentially contact the fins of the upper drum shell or shells in the corresponding series, said solution outlets of the lowermost drum shells are connected to a solution outlet pipe, and said vapor outlet of said each drum shell is connected to a vapor outlet pipe.

* * * * *